109-83 SR
6/19/79 XR 4,158,338

United States Patent [19]
Dippold et al.

[11] 4,158,338
[45] Jun. 19, 1979

[54] WALL PANEL AND ASSEMBLY

[75] Inventors: Johann Dippold, Plochingen; Wolf von Tirpitz, Reudern, both of Fed. Rep. of Germany

[73] Assignee: Feldmühle Aktiengesellschaft, Düsseldorf-Oberkassel, Fed. Rep. of Germany

[21] Appl. No.: 840,171

[22] Filed: Oct. 7, 1977

[30] Foreign Application Priority Data

Oct. 11, 1976 [GB] United Kingdom ..... 42123/76

[51] Int. Cl.[2] ..... E05G 1/024
[52] U.S. Cl. ..... 109/79; 109/83
[58] Field of Search ..... 109/78, 80, 82, 83, 109/84, 49.5, 79; 89/36 R

[56] References Cited

U.S. PATENT DOCUMENTS

| | | | |
|---|---|---|---|
| 952,877 | 3/1910 | Cowper-Coles | 109/82 X |
| 1,084,986 | 1/1914 | Wernicke | 109/84 |
| 1,423,652 | 7/1922 | Edmondson | 109/84 |
| 1,546,403 | 7/1925 | Raven | 109/84 X |
| 3,453,974 | 7/1969 | Gerard | 109/83 |

FOREIGN PATENT DOCUMENTS

| | | | |
|---|---|---|---|
| 73507 | 8/1944 | Czechoslovakia | 109/83 |
| 2205498 | 8/1973 | Fed. Rep. of Germany | 109/83 |

*Primary Examiner*—Mervin Stein
*Assistant Examiner*—David H. Corbin
*Attorney, Agent, or Firm*—Hans Berman

[57] ABSTRACT

A wall panel consisting of two laminar units each including a core layer of particulate, sintered, aluminum oxide, a perforated metal shell enveloping the layer, and a continuous mass consisting essentially of elastomeric material enveloping the shell and extending into the layer through the perforations of the shell. The mass bonds the particles in the layer to each other and to the shell, and the two masses constitute a unitary body connecting the shells in a position in which the core layer of one unit projects beyond the core layer of the other unit so as to define a rabbet. Two such panels may engage each other in a rabbet joint in which the projecting core layer parts are spacedly superimposed on each other to provide a burglar resistant connection between the panels which themselves are difficult to penetrate by burglar's tools.

13 Claims, 10 Drawing Figures

Fig. 2
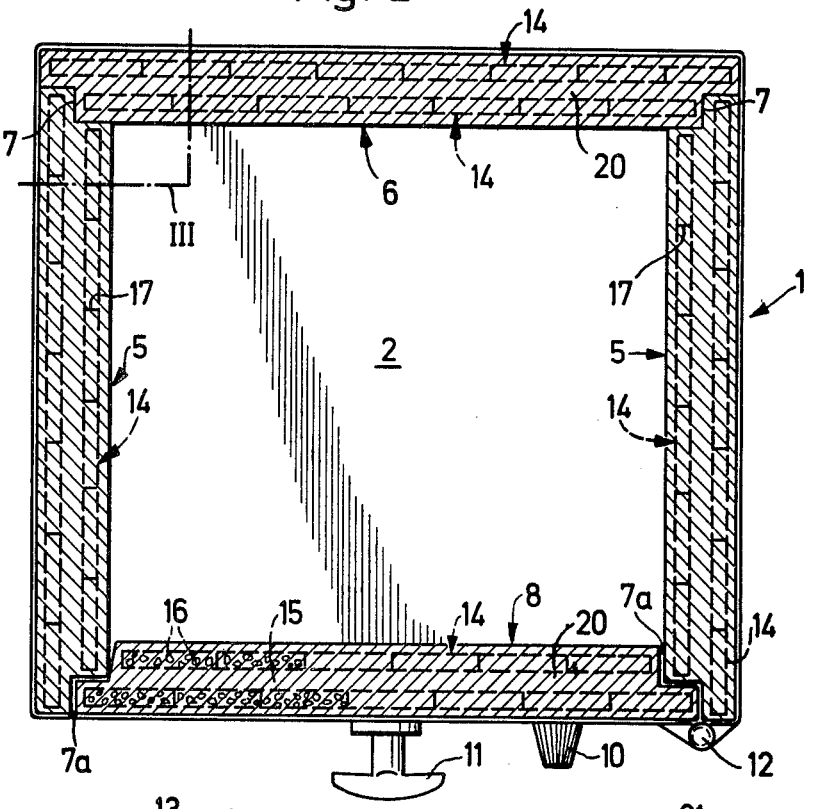
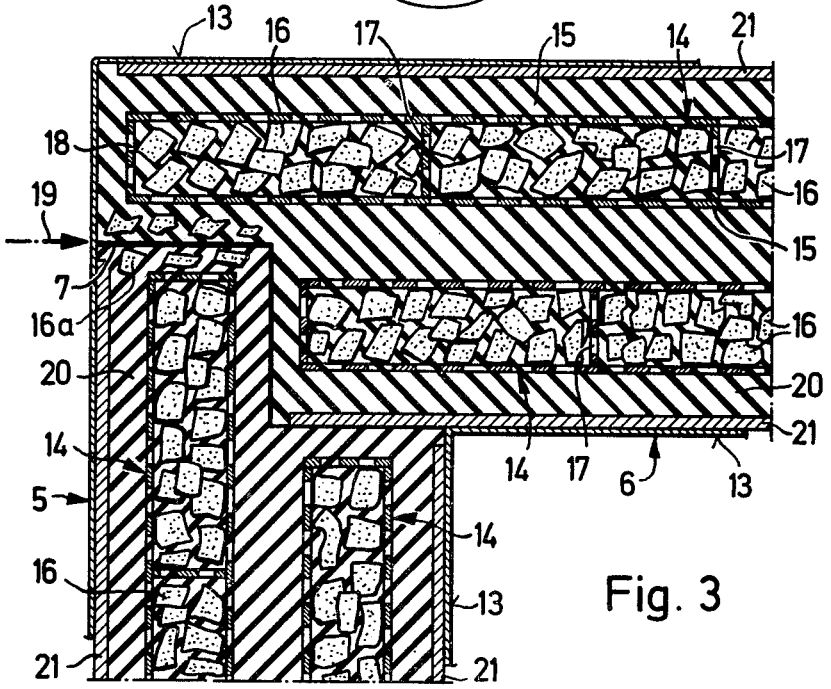
Fig. 3

WALL PANEL AND ASSEMBLY

This invention relates to wall panels and assemblies of wall panels suitable for protecting the contents of a safe against burglars, and particularly to panels and panel assemblies in which such protection is afforded by a combination of very hard material, such as sintered aluminum oxide, and an elastomeric materal, such as natural or synthetic rubber.

It is known from the commonly owned U.S. Pat. Nos. 3,871,026 and 3,793,648, that a structure combining very hard and brittle material, such as aluminum oxide, with an elastomeric material has great advantages in a bullet resistant helmet or shield.

It has now been found that a basically similar combination of materials may be shaped to provide a wall panel offering better resistance to burglar's tools than an equal weight of high-strength steel, concrete, or steel-reinforced concrete, and that such panels may be joined to each other in a manner to make the joint as burglar resistant as the panels themselves.

In one of its more specific aspects, the invention provides a wall panel of much smaller thickness than length or width which includes two laminar units. Each unit has a core layer of very hard particulate material, a shell of perforated sheet material enveloping the layer, and a continuous mass consisting essentially of elastomeric material enveloping the shell and extending into the layer through the performations of the shell to bond the particles of the layer to each other and to the shell. The masses of the two units are integrally connected to constitute a unitary body connecting the shells in a position in which the core layer of one unit projects beyond the core layer of the other unit.

Two such wall panels, in each of which the two units define a rabbet, may engage each other in a rabbet joint in such a manner that the projecting part of one core layer in each of the two panels is spacedly aligned with a core layer in the other panel in the direction of panel thickness.

Other features, additional objects, and many of the attendant advantages of this invention will readily be appreciated as the same becomes better understood by reference to the following detailed description when considered in connection with the appended drawing in which:

FIG. 2 illustrates the safe of FIG. 1 in plan section on the line II—II;

FIG. 3 shows a portion of FIG. 2 indicated by the chain-dotted line III on a larger scale;

Figure 1:
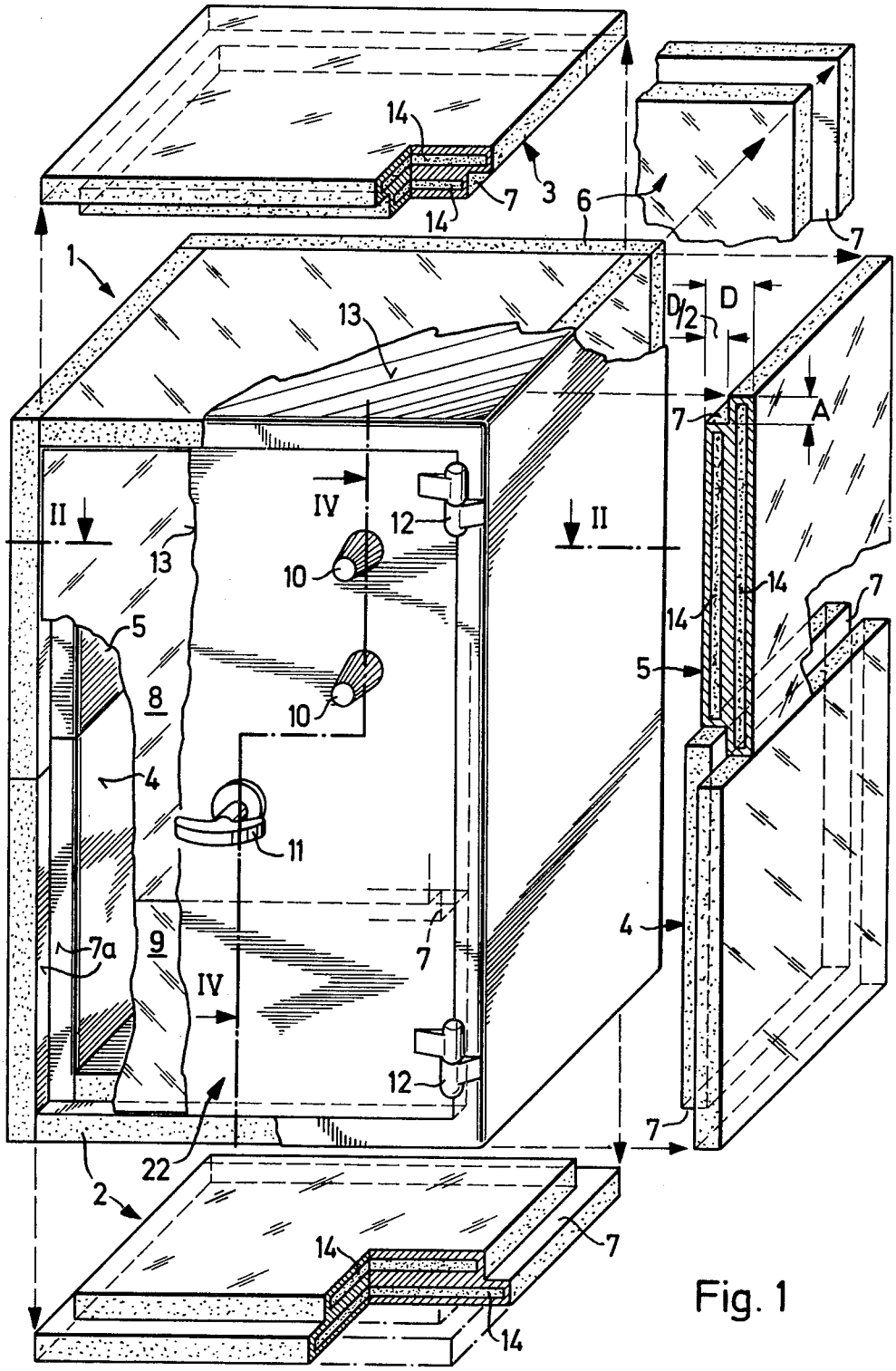
FIG. 1 shows a safe according to the invention in a perspective, partly exploded view, portions being broken away to reveal internal structure.

Referring now to the drawing in detail, and initially to FIG. 1, there is shown a safe 1 of rectangular configuration whose bottom wall includes a wall panel 2. The top wall includes a panel 3, and each of the side walls mainly consists of a lower panel 4 and an upper panel 5. The rear wall is similarly constituted primarily by wall panels 6. Hinges 12 attach the door 22 of the safe to one of the side walls, the door including a larger upper panel 8 and a smaller, lower panel 9. Knobs 10 may be set for the code number which permits the lock of the safe to be opened by means of the handle 11 in a conventional manner, now shown.

Each of the rectangular panels 2–9 is formed with rabbets **7,7*a* in its four narrow, elongated edge portions which extend between the major inner and outer faces of each panel. Rabbet joints connect the several panels to form a continuous box structure when the door 22 is closed. The box structure is covered by outer and inner casings 13** of relatively thin sheet metal butt-welded along the edges of the safe.

Figure 4:
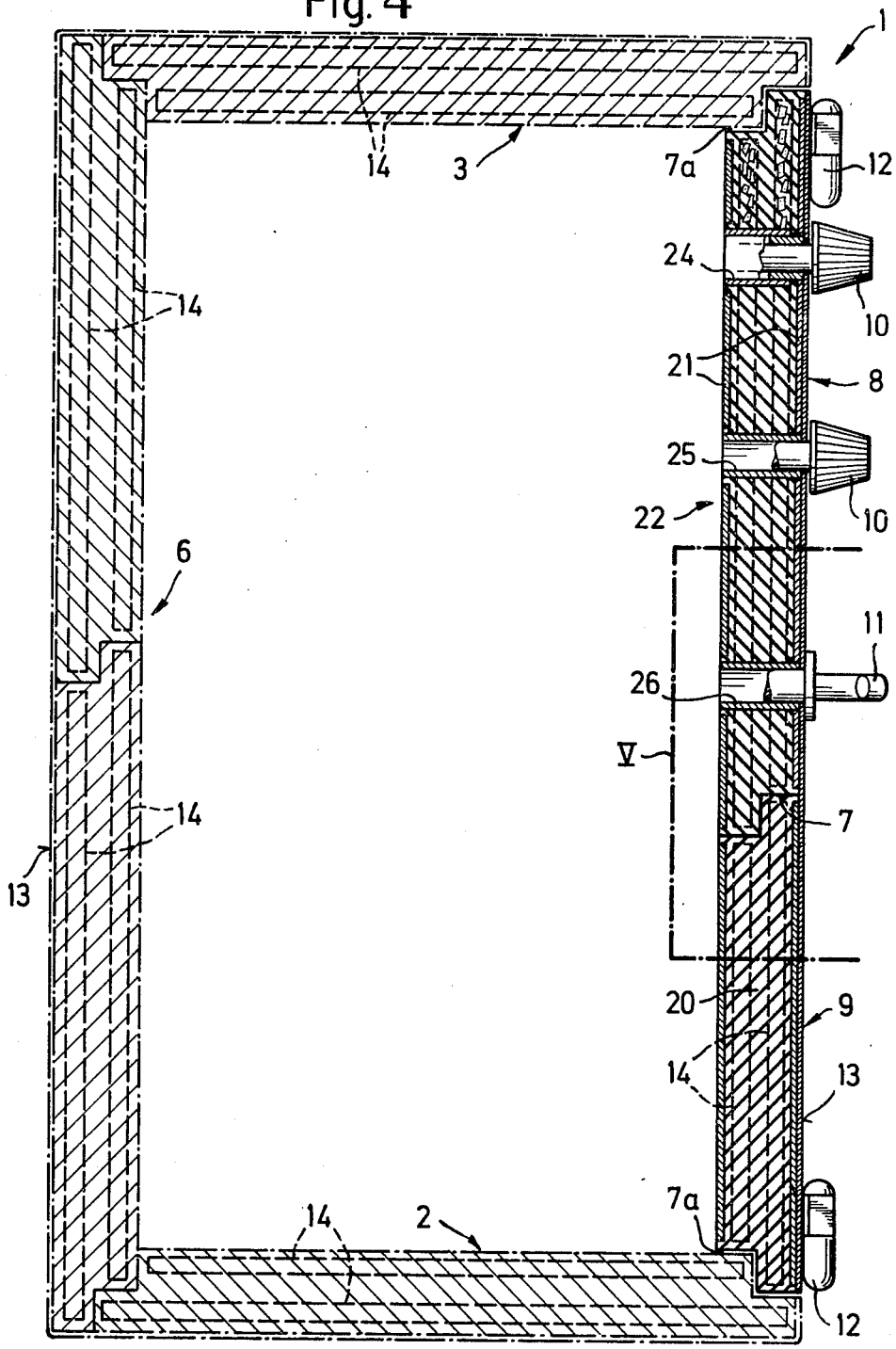
FIG. 4 illustrates the safe of FIG. 1 in fragmentary, somewhat enlarged, elevational section on the line IV—IV.
Figure 5:
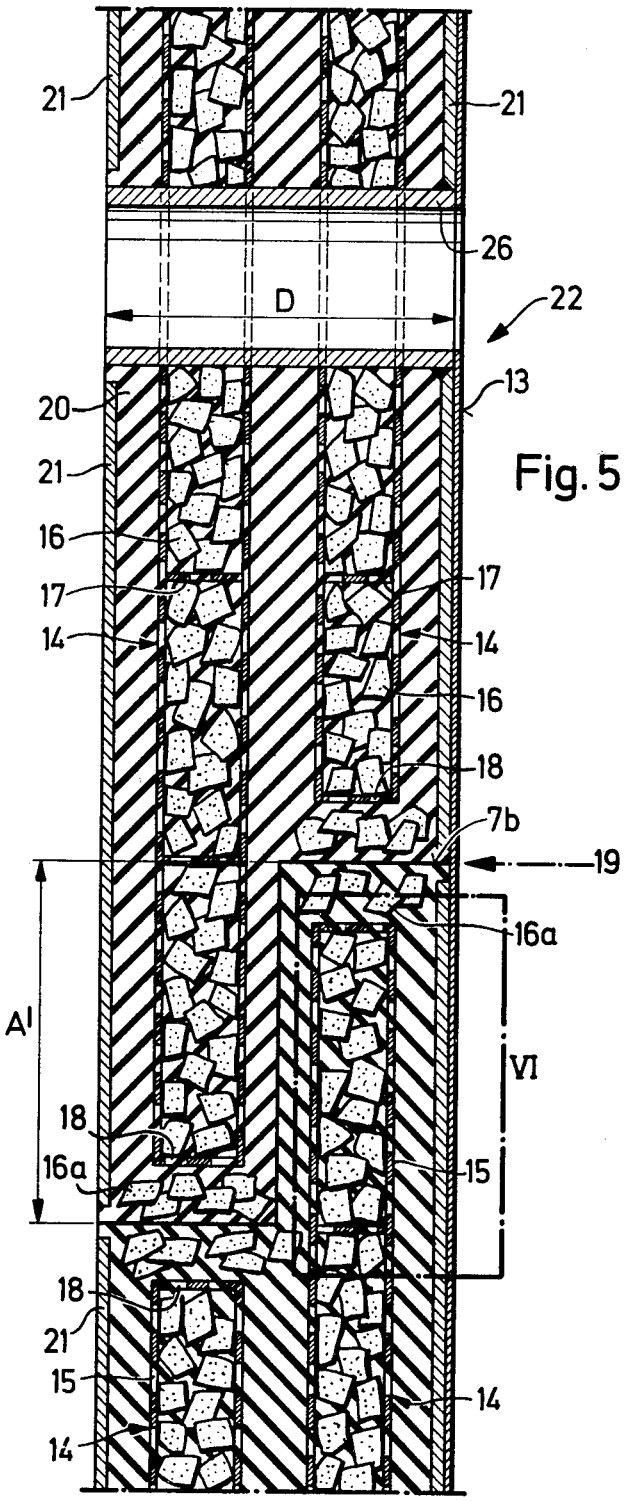
FIG. 5 shows the portion of FIG. 4 indicated by the chain dotted line V on a further enlarged scale.
Figure 6:
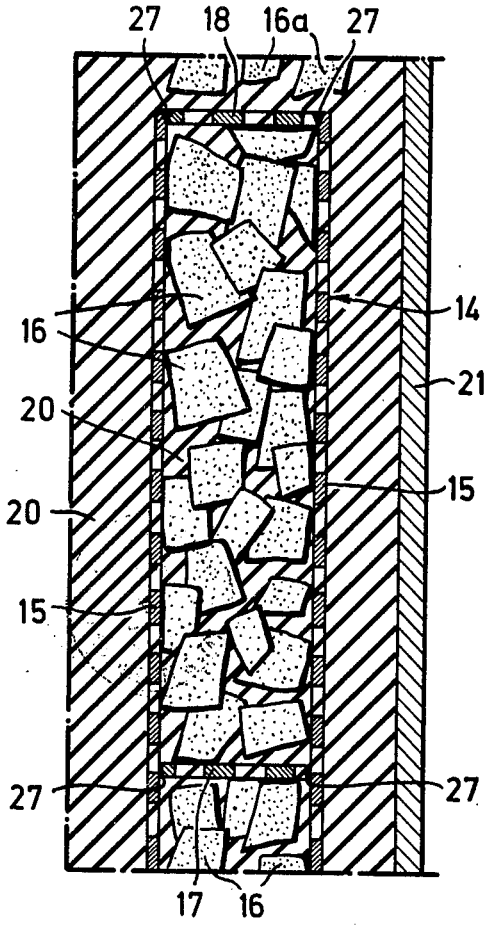
FIG. 6 is a view of the portion of FIG. 5 indicated by the chain-dotted line VI on yet a larger scale.

As is better seen in FIGS. 2 to 6, particularly FIGS. 3 and 6, each panel consists of two flat, rectangular units. At the core of each unit is a tightly packed layer 14 of particulate, sintered aluminium oxide having a hardness of 8.9 on the Mohs scale, the individual particles 16 being angular and having each a volume of about 0.5 to 2 $cm^3$. The alumina particles of each layer are confined in a shell whose major, planar walls 15 consist of perforated sheet metal which also constitutes narrow edge walls 18 of each shell and partitions 17 parallel to the edge walls which divide the cavity of each shell into compartments to facilitate even distribution of the alumina particles 16 over the length and width of each layer 14. Butt welds 27 (FIG. 6) connect the partitions 17 and edge walls 18 to the major face portions 15 of the shells.

Each unit further includes a mass of filter-reinforced elastomeric material, such as natural or synthetic rubber which fills the interstices between the particles 16 in each shell, the perforations of the shell walls 15, 17 and partitions 17, and completely covers all outer faces of the shell in an approximately uniform layer. The elastomeric masses of the two units are integrally jointed in a unitary body 20 whose major outer faces are further vulcanized to covering metal plates 21. The elastomeric material bonds the two units to each other and also bonds the particles 16 in each layer 14 to each other and to the confining shell.

At the rabbet joints **7,7*a*, the elastomeric layers 20 are partly exposed and in contact with each other without protection by metal plates 21. Where seams 19 in the rabbet joints are perpendicular to an outer surface of the safe 1, the elastomeric material covering the narrow rabbet faces is reinforced by molded-in alumina particles 16*a***.

The filler in the body 20 may include enough antimony oxide to make the mainly elastomeric mass more flame resistant and at least 5 parts by weight asbestos fibers, hydrargillite powder, and/or silica per 100 parts of elastomer base. Not more than 100 parts of each filler should be incorporated in a natural rubber base, and not more than 200 parts in polychloroprene rubber. Magnesium oxide, other types of aluminum oxide, and other silicates may also be employed as fillers to achieve a desired fusion temperatures and melt viscosity of the residue resulting from thermal decomposition of the body 20.

Steel tubes 24, 25, 26 pass through the wall panel 8 of the safe door 22 inward of the outer casing 13, as is best seen in FIGS. 4 and 5, and sequentially penetrate the several layers of the panel, that is, an outer unit consisting of an outer metal plate 21, a first elastomer layer, an outer wall of a shell 15, and a central, second elastomer layer, and thereafter the other unit of the panel in inverse order of layers.

For greater resistance to burglar's tools, the core layers 14 of adjacent wall panels overlap each other. The layer 14 in one unit of each panel thus extends beyond the corresponding layer of the other unit in the direction of panel width or length by at least one quarter of the total panel thickness D, typically about 80 mm, the thickness of each panel unit being D/2. As is shown in FIG. 1, the depth A of the rabbets is equal to the unit thickness D/2, and the outer layer 14 projects beyond the inner layer 14 by the same distance. The depth A' of the rabbets in the door panels (FIG. 5) is approximately equal to the panel thickness, and the layer 14 of alumina particles 16 in one panel unit projects by the same amount beyond the other alumina layer in the same panel, the thickness of each layer being preferably 14–30 mm.

It is relatively easy to drill through the metal layers 13, 21, but even high-speed drills become dull quickly in the reinforced elastomeric layer between the plate 21 and the shell 15. The tightly packed, but resiliently bonded alumina particles 16 are even more deleterious to the cutting edges of drills. While the panels 2–9 cannot resist a skillful burglar indefinitely, they may sufficiently retard his progress to discourage him from achieving his goal if the available time is limited. Because of the filers in the elastomeric mass 20, the walls of a safe assembled from panels of this invention resist cutting with welder's torches. The organic material is scorched relatively quickly, but the inorganic fillers are fused into a continuous skin which hardens as soon as the torch is withdrawn and blocks easy access to the interior of the safe.

Figure 7:
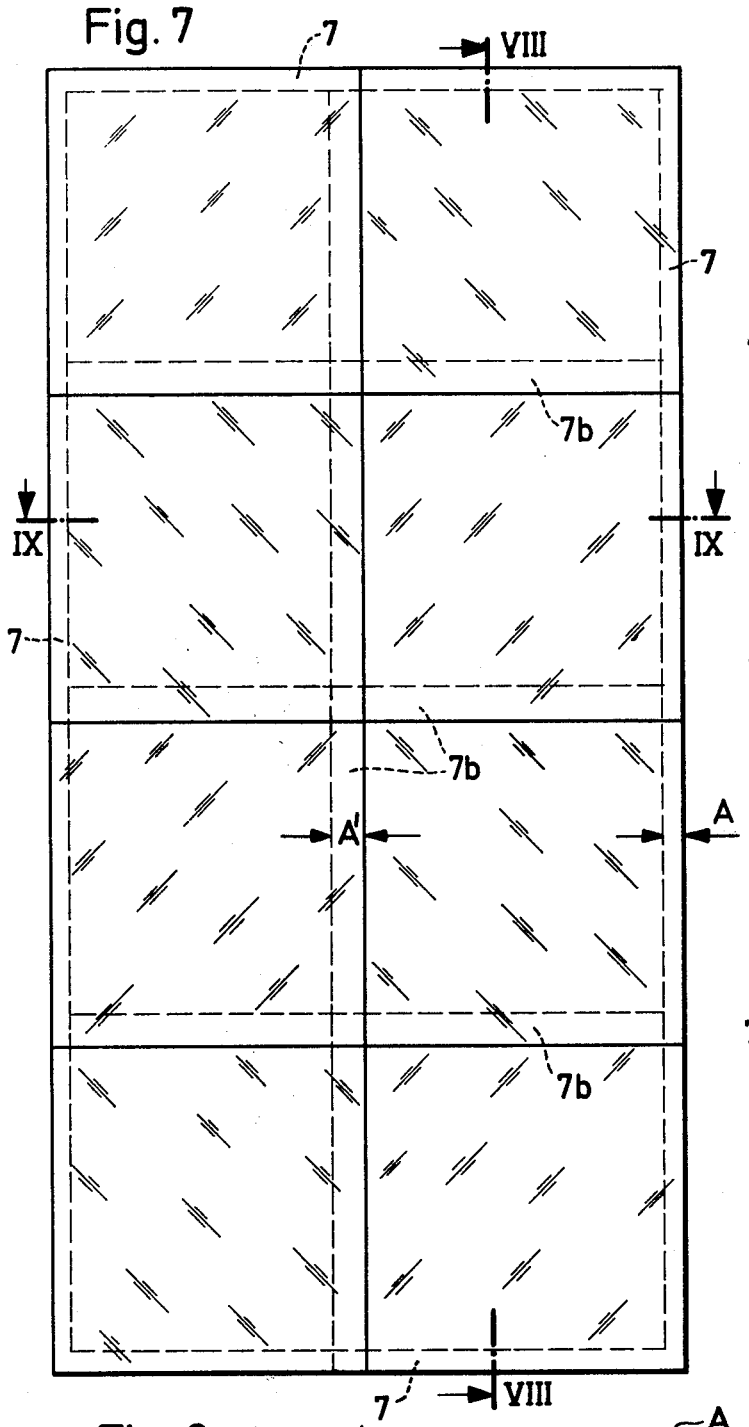
FIG. 7 shows a wall of another safe of the invention in elevation.
Figure 8:
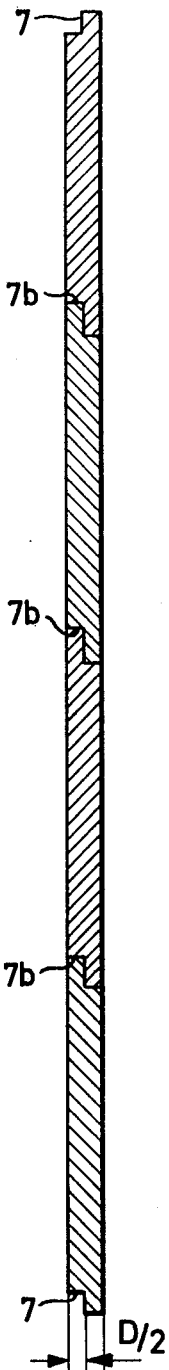
FIGS. 8 and 9 illustrate the wall of FIG. 7 in simplified section on the lines VIII—VIII and IX—IX respectively.
Figure 9:
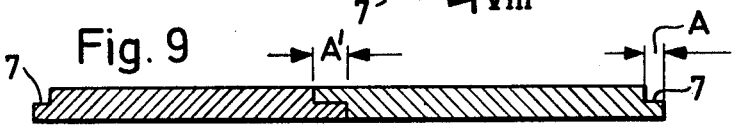

The safe shown in FIGS. 1 to 6 is small enough that it may be assembled from relatively few panels. However, many more panels may be connected by rabbet joints to build large safes from a few types of square standard panels, as is shown in FIGS. 7 to 9.

Greater protection against a welder's torch is provided in a safe, partly illustrated in FIG. 10, whose walls include wall panels consisting of two shells having major walls 15 and filled with alumina particles 16 and a unitary body 20 of elastomer-based material, the several panels being covered with metal plates 21 and connected by rabbet joints as described above, but not specifically shown in FIG. 10. A second metal plate 21 is fastened by welding to each plate 21 covering the elastomeric body 20. The outer double layer of metal plates 21 is further overlaid with a foamable layer 30 consisting of pulverulent, hydrated sodium silicate and glass fibers held together by an organic binder and coated with an epoxy resin for protection against atmospheric deterioration. The foamable composition bounds inwardly an air space 29 whose outer wall is a metal plate 21 lined with a sheet of asbestos 28.

Figure 10:
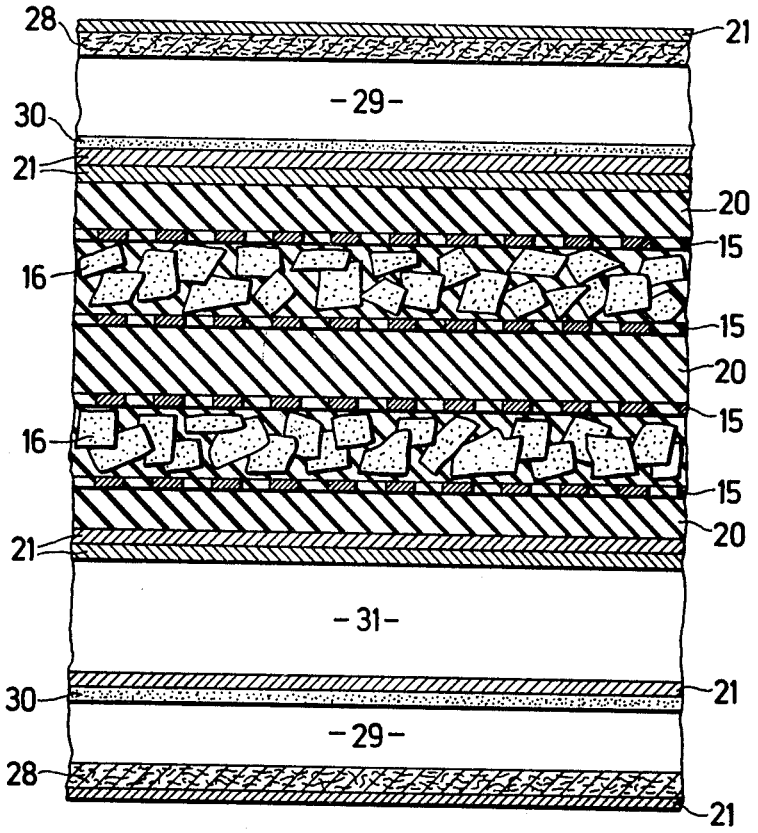
FIG. 10 shows a wall of a further safe of the invention in fragmentary plan section.

The inner double layer of metal plates 21 bounds the internal chamber 31 of the safe the width of which has been reduced greatly in FIG. 10 for the convenience of pictorial representation. The other wall of the safe bounding the chamber 31 is designed to protect the chamber against a torch, but is not intended to resist drilling tools. It thus includes two metal plates 21 separated by an air space 29 in which they carry a foamable layer 30 and a sheet of asbestos 28 respectively.

Under attack by a torch, the layers 30 soften at temperatures up to about 100° C. Between 100° to 150° C. they are expanded by the steam released from the silicate into a cellular structure, the heat for evaporation of the water being withdrawn from the supporting metal plates 21 which are thereby further protected. Ultimately, the air space 29 is completely filled with the cellular structure which is stable at temperatures above 150° C. and interferes with access to the chamber 31.

While sintered aluminum oxide has been described above as the material of the particles 16 and offers a particularly attractive combination of ready availability in suitable quality and quantity with low cost, silicon carbide, boron carbide, and other hard or very hard materials may be substituted. At least some of the advantages of this invention are available with polycrystalline particles having a hardness of at least 7 on the Mohs scale.

The illustrated panels of the invention consist of two integrally joined units of practically identical, laminar structure, and burglar resistant rabbet joints between juxtaposed panels cannot be had with fewer than two superimposed units of this type. However, more than two units may be integrally joined by a common, unitary body of elastomeric material, and such multiple panels may be connected by tongue-and-groove joints in an obvious manner.

The wall panels of the invention are assembled by filling shells 15 with particles 16 and thereafter welding the shells shut. Several layers of elastomeric material are sandwiched with the filled shells between the platens of a hydraulic press in a mold which, upon curing of the elastomer under adequate heat and pressure produces the illustrated panels.

It should be understood, of course, that the foregoing disclosure relates only to preferred embodiments and that it is intended to cover all changes and modifications of the examples of the invention chosen herein for the purpose of the disclosure which do not constitute departures from the spirit and scope of the invention set forth in the appended claims.

What is claimed is:

1. A wall assembly comprising two wall panels, (a) each panel having a thickness smaller than the length and width thereof and including two laminar units superimposed in the direction of said thickness, each unit including (1) a core layer of particulate material having a hardness greater than 7 on the Mohs scale, (2) a shell of perforated sheet material enveloping said layer, and (3) a continuous mass consisting essentially of elastomeric material enveloping said shell and extending into said layer through the perforations of said shell, said mass bonding the particles of said layer to each other and to said shell, (b) the masses of said two units being integrally connected to constitute a unitary body connecting said shells in a position in which a part of the core layer of one of said units projects beyond the core layer of the other unit by a distance at least equal to one quarter the thickness of said panel, but by not more than twice said thickness, (c) said two panels engaging each other in a joint, the projecting part of the core layer in said one unit of each panel being aligned in said joint with a core layer in the other panel in the direction of the thickness of said one panel.

2. A wall assembly as set forth in claim 1, wherein the particles of said particulate material consist essentially of silicon carbide, boron carbide, or aluminum oxide, and have each a volume of 0.5 to 2 cubic centimeters, said layers of particulate material having each a thickness of 14 to 30 mm.

3. A wall assembly as set forth in claim 1, wherein said two units of each panel define a rabbet, and said two panels engage each other in a rabbet joint, the projecting part of the one core layer in one of said two panels being spacedly superimposed on the projecting part of the one core layer in the other one of said two panels in said rabbet joint.

4. A wall assembly as set forth in claim 3, wherein said unitary body of said one panel has a face directed away from said shells, the assembly further comprising a metal plate secured to said face of said unitary body.

5. A wall assembly as set forth in claim 4, further comprising another metal plate spacedly opposite said secured metal plate, said metal plates defining an air space therebetween, and a layer of heat resistant material on at least one of said metal plates in said air space.

6. A wall assembly as set forth in claim 5, wherein said heat resistant material is asbestos 7. A wall assembly as set forth in claim 5, wherein said heat resistant material expands into a cellular structure when exposed to a temperature above 100° C.

8. A wall assembly as set forth in claim 1, wherein each of said shells has two outer faces, one outer face of each shell being spacedly parallel to one outer face of the other shell, said mass filling the space between said parallel outer faces.

9. A wall assembly as set forth in claim 8, wherein said sheet material is metallic.

10. A wall assembly as set forth in claim 1, wherein each shell bounds a cavity therein and has first and second major outer faces and an edge face narrower than said major faces, said edge face connecting said major faces and extending about each major face in a closed loop, said core layer consisting essentially of alumina particles tightly packed in said cavity.

11. A wall assembly as set forth in claim 10, wherein the major faces of said shells are substantially parallel, the major faces of one of said shells projecting beyond the major faces of the other shell.

12. A wall assembly as set forth in claim 10, further comprising partition means in each of said cavities for holding said particulate material substantially uniformly distributed in the cavity.

13. A wall assembly as set forth in claim 10, further comprising a plurality of particles of said particulate material embedded in said continuous body contiguously adjacent said one edge portion outside the cavities of said shells.

* * * * *